US011731237B2

(12) United States Patent
Hayavi

(10) Patent No.: US 11,731,237 B2
(45) Date of Patent: Aug. 22, 2023

(54) PRECISION SQUEEGEE GRINDER APPARATUS

(71) Applicant: Jabil Inc., St. Petersburg, FL (US)

(72) Inventor: Hadi Hayavi, St. Petersburg, FL (US)

(73) Assignee: Jabil Inc., St. Petersburg, FL (US)

( * ) Notice: Subject to any disclaimer, the term of this patent is extended or adjusted under 35 U.S.C. 154(b) by 816 days.

(21) Appl. No.: 16/689,559

(22) Filed: Nov. 20, 2019

(65) Prior Publication Data

US 2021/0146500 A1 May 20, 2021

(51) Int. Cl.
*B24B 41/00* (2006.01)
*B24B 49/00* (2012.01)
*B24B 9/20* (2006.01)

(52) U.S. Cl.
CPC ..... *B24B 41/005* (2013.01); *B24B 9/20* (2013.01); *B24B 49/00* (2013.01)

(58) Field of Classification Search
CPC ..... B24B 41/005; B24B 41/02; B24B 9/20; B24B 9/02; B24B 49/00; B41F 15/42
See application file for complete search history.

(56) References Cited

U.S. PATENT DOCUMENTS 3,361,059 A * 1/1968 Klingler ..... B41F 9/1036 101/169
4,334,448 A * 6/1982 Messerschmitt ..... B26D 3/003 83/16

(Continued)

FOREIGN PATENT DOCUMENTS

CN 2190559 Y 3/1995
CN 103639892 A * 3/2014 ..... B24B 19/00

(Continued)

OTHER PUBLICATIONS

CN103639892A EspaceNet EnglishTranslation (Year: 2014).*

(Continued)

*Primary Examiner* — Joel D Crandall
*Assistant Examiner* — Makena S Markman
(74) *Attorney, Agent, or Firm* — Young Basile Hanlon & MacFarlane, P.C.

(57) ABSTRACT

A precision squeegee grinder including a grinder assembly configured to grind an edge of a squeegee blade, a squeegee mounting assembly configured to hold the squeegee blade, a grinder assembly vertically alignable with respect to the squeegee mounting assembly, a latitudinal movement assembly connected to the grinder assembly, the latitudinal movement assembly configured to position the grinder assembly with respect to the squeegee blade in defined increments, a longitudinal movement assembly connected to the latitudinal movement, the longitudinal movement assembly configured to move the grinder assembly along a width of the squeegee blade, and a base assembly. The grinder assembly, the squeegee mounting assembly, the latitudinal movement assembly, and the longitudinal movement assembly are connected to the base assembly. The squeegee mounting assembly, the latitudinal movement assembly, and the longitudinal movement assembly enable triaxial alignment between the grinder assembly and the squeegee blade.

12 Claims, 14 Drawing Sheets

(56) References Cited

U.S. PATENT DOCUMENTS

| | | | | | |
|---|---|---|---|---|---|
| 4,516,451 | A * | 5/1985 | Takeshita | B26D 3/02 | 83/486.1 |
| 5,335,573 | A * | 8/1994 | Rogers | B26D 7/025 | 83/870 |
| 6,026,724 | A * | 2/2000 | Hagen | B26D 3/003 | 83/614 |
| 6,276,988 | B1 * | 8/2001 | Chen | B24B 55/06 | 451/5 |

FOREIGN PATENT DOCUMENTS

| | | | | |
|---|---|---|---|---|
| CN | 204135864 | U | | 2/2015 |
| CN | 208148767 | U | | 11/2018 |
| JP | H081501 | A | | 1/1996 |
| JP | 2004167644 | A | * | 6/2004 |
| JP | 2004167644 | A | | 6/2004 |
| JP | 3144887 | U | | 9/2008 |

OTHER PUBLICATIONS

JP2004167644A EspaceNet English Translation (Year: 2004).*
Extended European Search Report in corresponding European Patent Application 20891002.6, dated Nov. 11, 2022, 8 pgs.

* cited by examiner

PRECISION SQUEEGEE GRINDER APPARATUS

TECHNICAL FIELD

This disclosure relates to printed electronics process manufacturing and in particular, to an apparatus for precision squeegee grinding.

BACKGROUND

Table-top devices for grinding squeegee blades are directed to servicing squeegee blades that print graphical inks on textiles, plastic substrates, and the like. These devices tend to be expensive, have larger comparative footprints, and lack the precision and adjustability necessary for preparing squeegee blades to print intricate circuitry trace lines. In particular, these devices cannot deliver the flat, uniform, and precise grinds required for printing intricate circuitry.

SUMMARY

Disclosed herein are implementations of devices and methods for precision grinding of squeegees. A precision squeegee grinder including a grinder assembly configured to grind an edge of a squeegee blade, a squeegee mounting assembly configured to hold the squeegee blade, a grinder assembly vertically alignable with respect to the squeegee mounting assembly, a latitudinal movement assembly connected to the grinder assembly, the latitudinal movement assembly configured to position the grinder assembly with respect to the squeegee blade in defined increments, a longitudinal movement assembly connected to the latitudinal movement, the longitudinal movement assembly configured to move the grinder assembly along a width of the squeegee blade, and a base assembly. The grinder assembly, the squeegee mounting assembly, the latitudinal movement assembly, and the longitudinal movement assembly are connected to the base assembly. The squeegee mounting assembly, the latitudinal movement assembly, and the longitudinal movement assembly enable triaxial alignment between the grinder assembly and the squeegee blade.

BRIEF DESCRIPTION OF THE DRAWINGS

The disclosure is best understood from the following detailed description when read in conjunction with the accompanying drawings and are incorporated into and thus constitute a part of this specification. It is emphasized that, according to common practice, the various features of the drawings are not to-scale. On the contrary, the dimensions of the various features are arbitrarily expanded or reduced for clarity.

DETAILED DESCRIPTION

Figure 1:
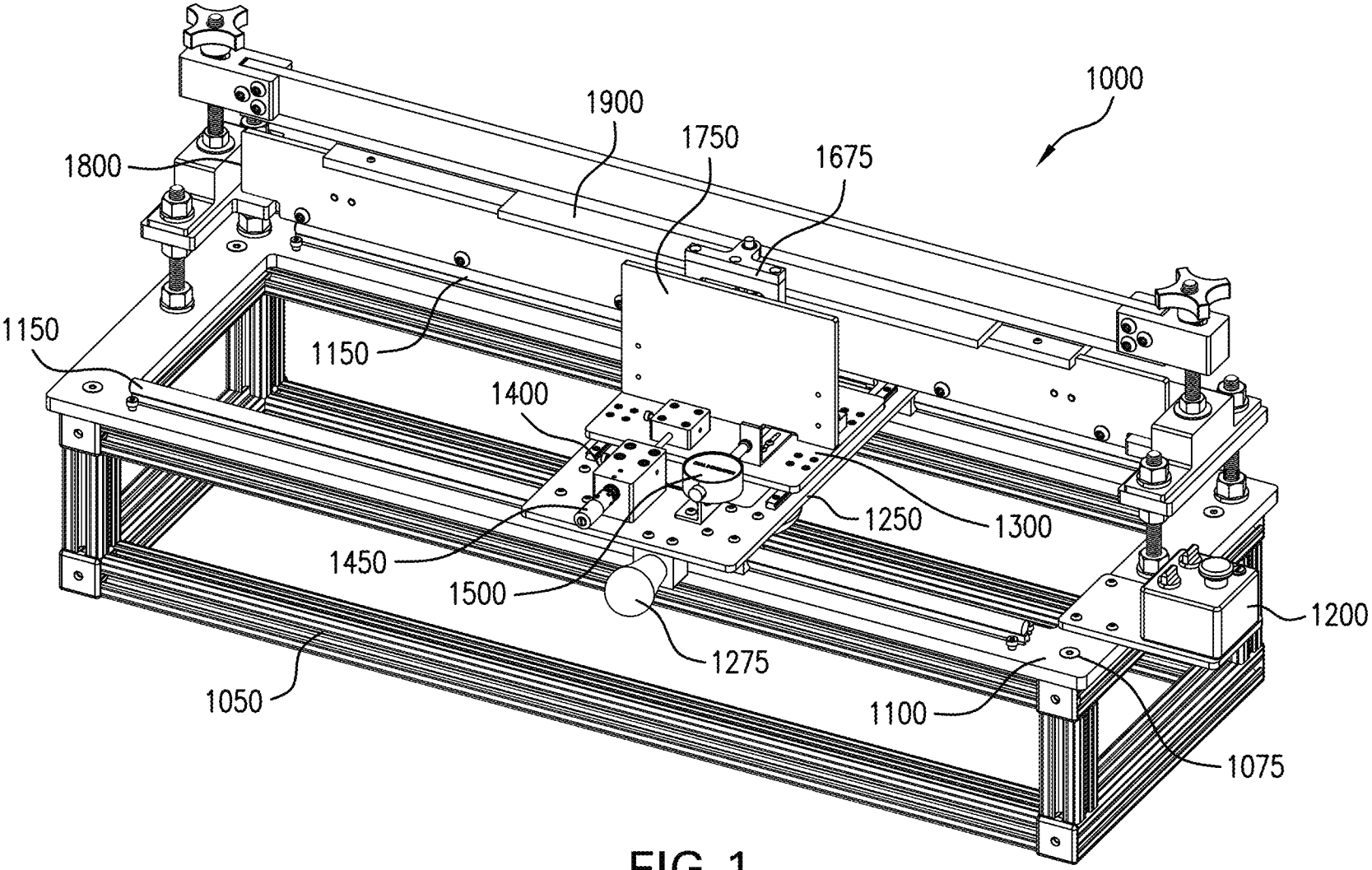
FIG. 1 is a perspective view of a precision squeegee grinder device according to embodiments.
Figure 2:
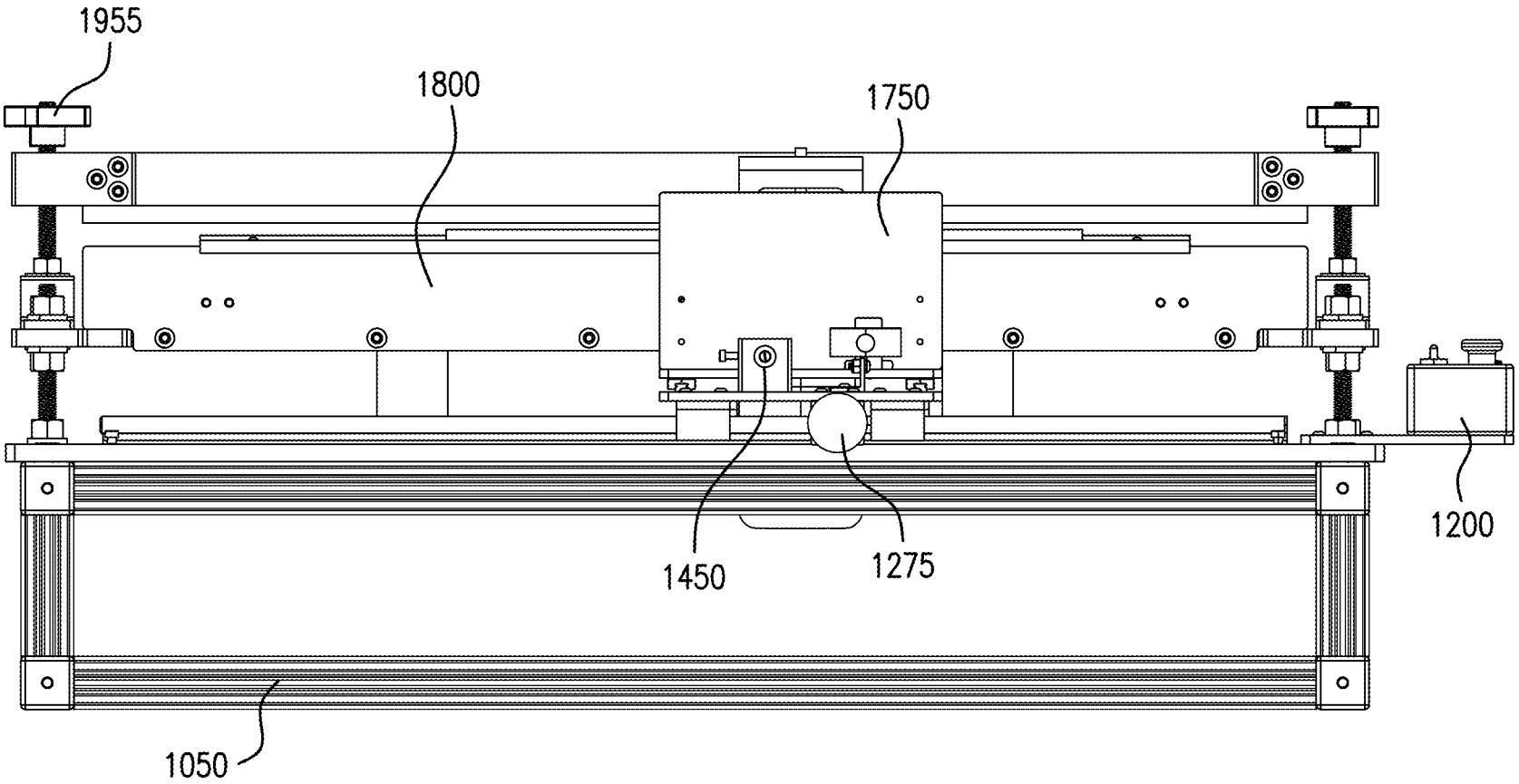
FIG. 2 is a front view of the precision squeegee grinder device of FIG. 1 according to embodiments.
Figure 3:
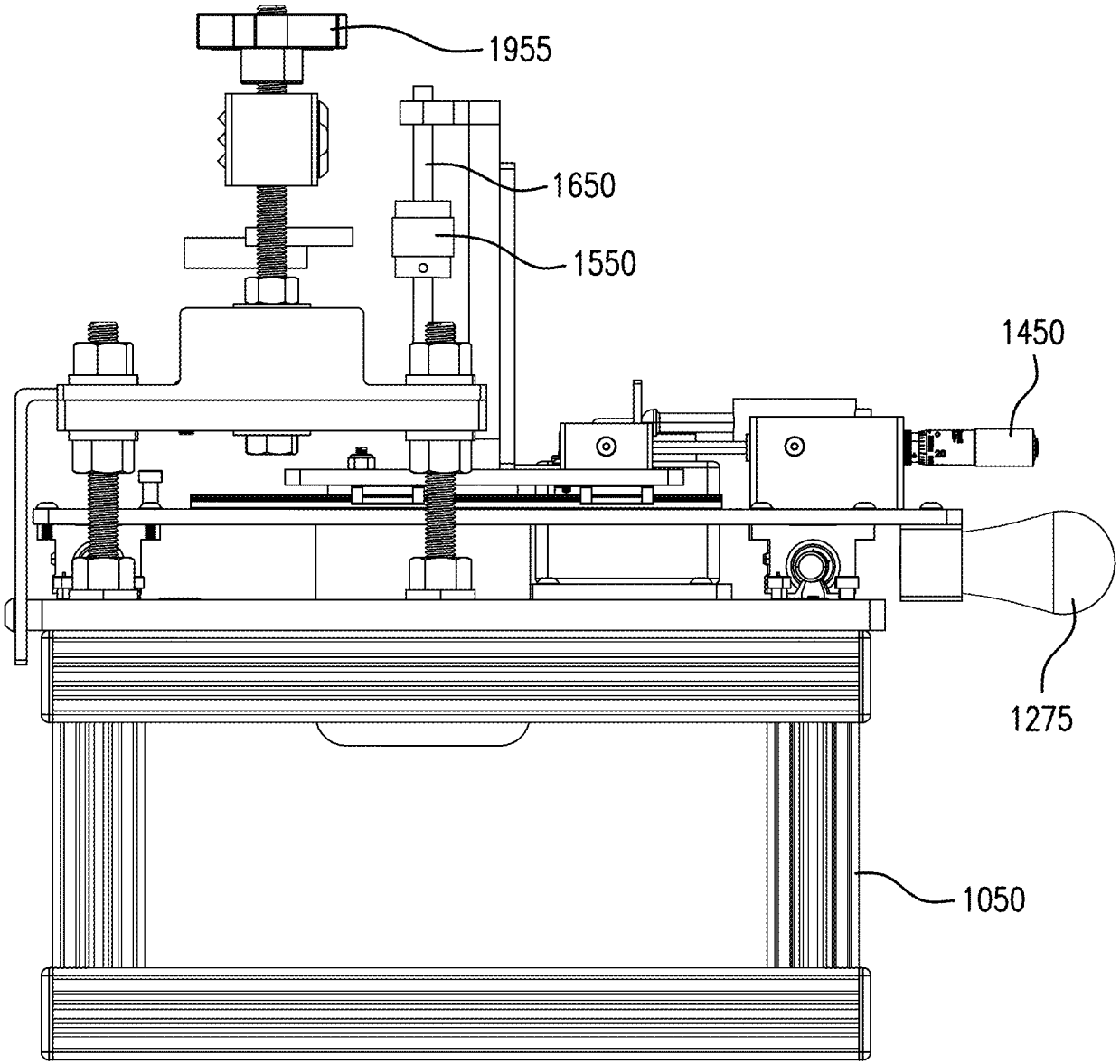
FIG. 3 is a left side view of the precision squeegee grinder device of FIG. 1 according to embodiments.
Figure 4:
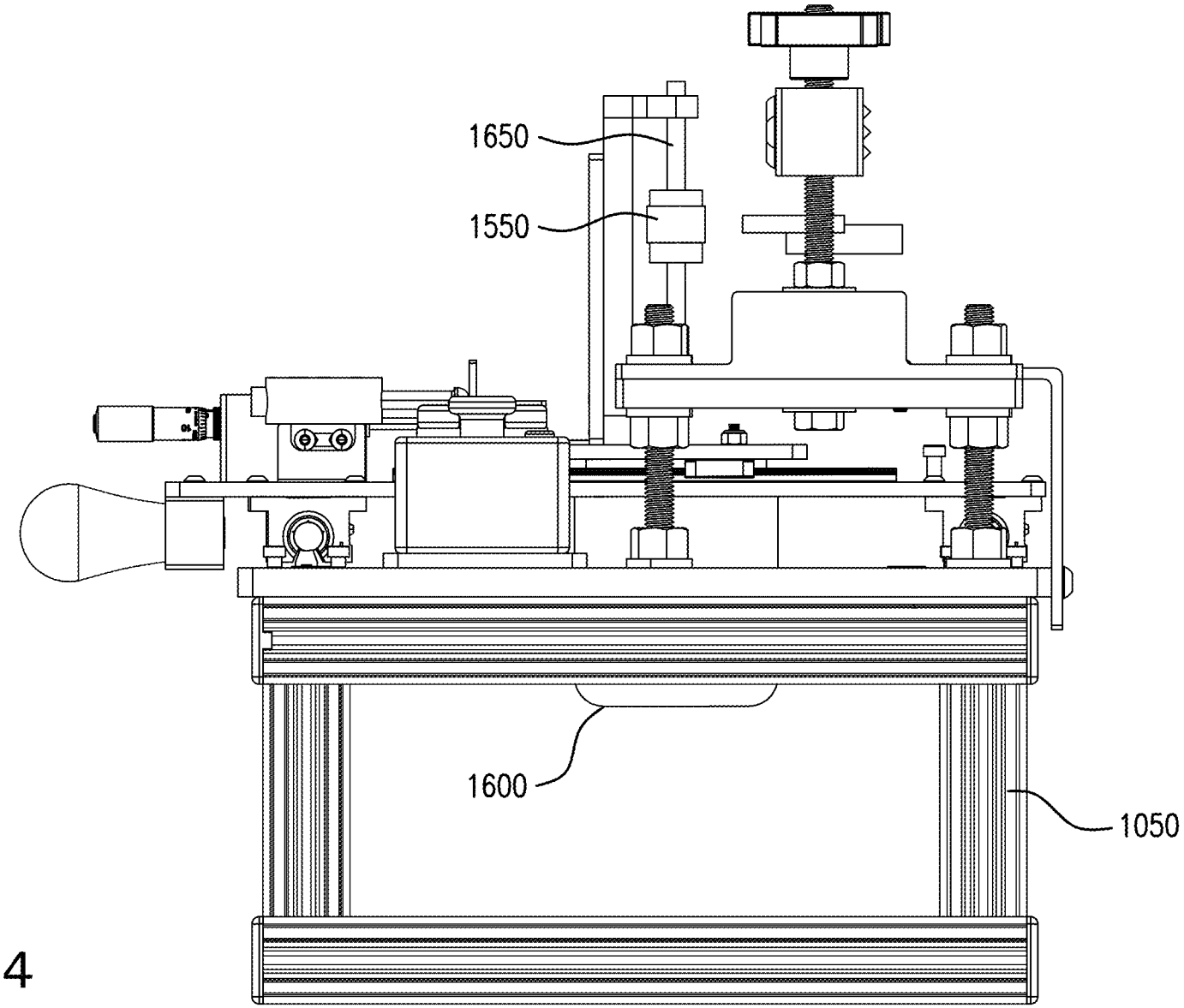
FIG. 4 is a right side view of the precision squeegee grinder device of FIG. 1 according to embodiments.
Figure 5:
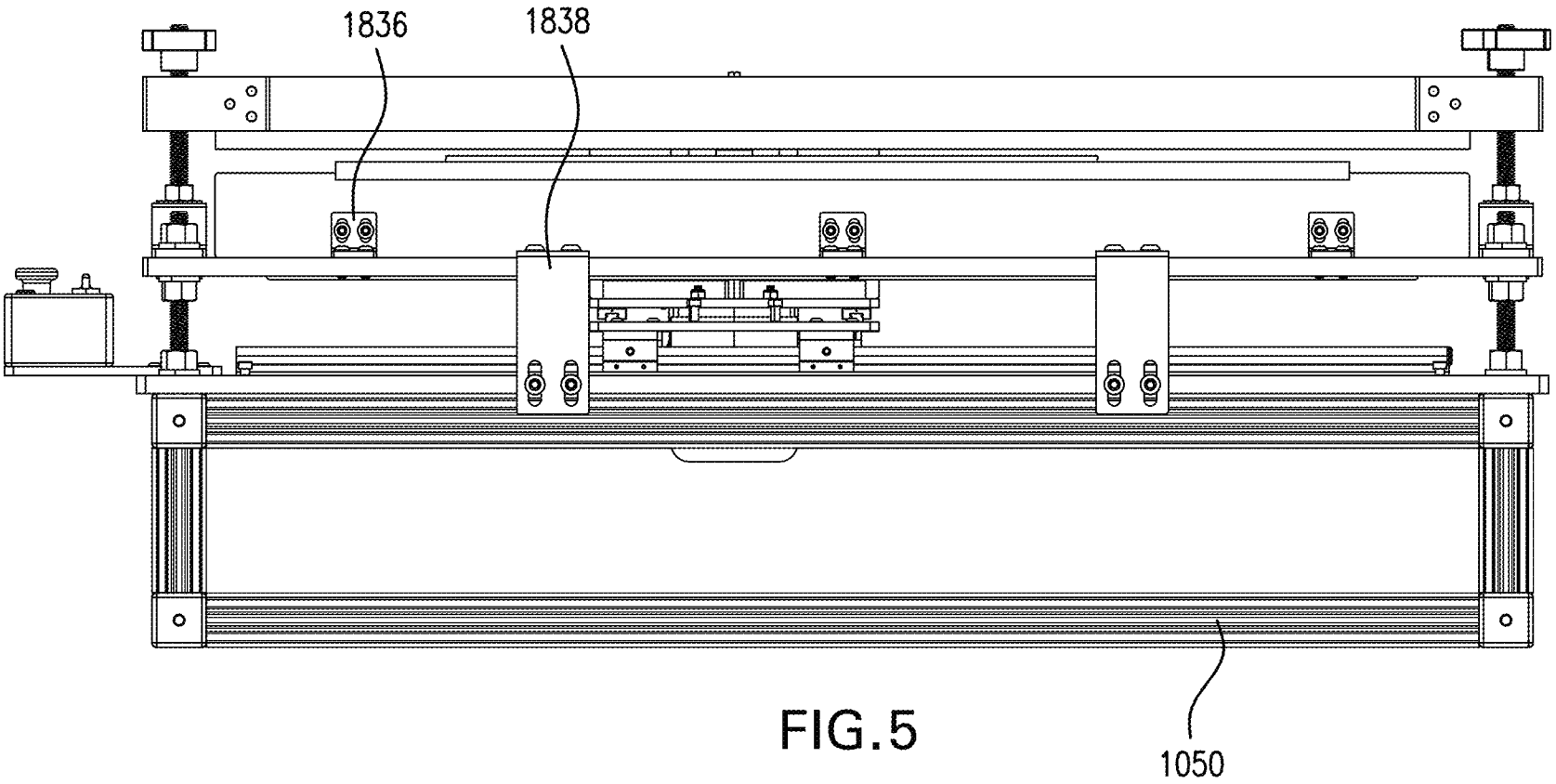
FIG. 5 is a back view of the precision squeegee grinder device of FIG. 1 according to embodiments.
Figure 6:
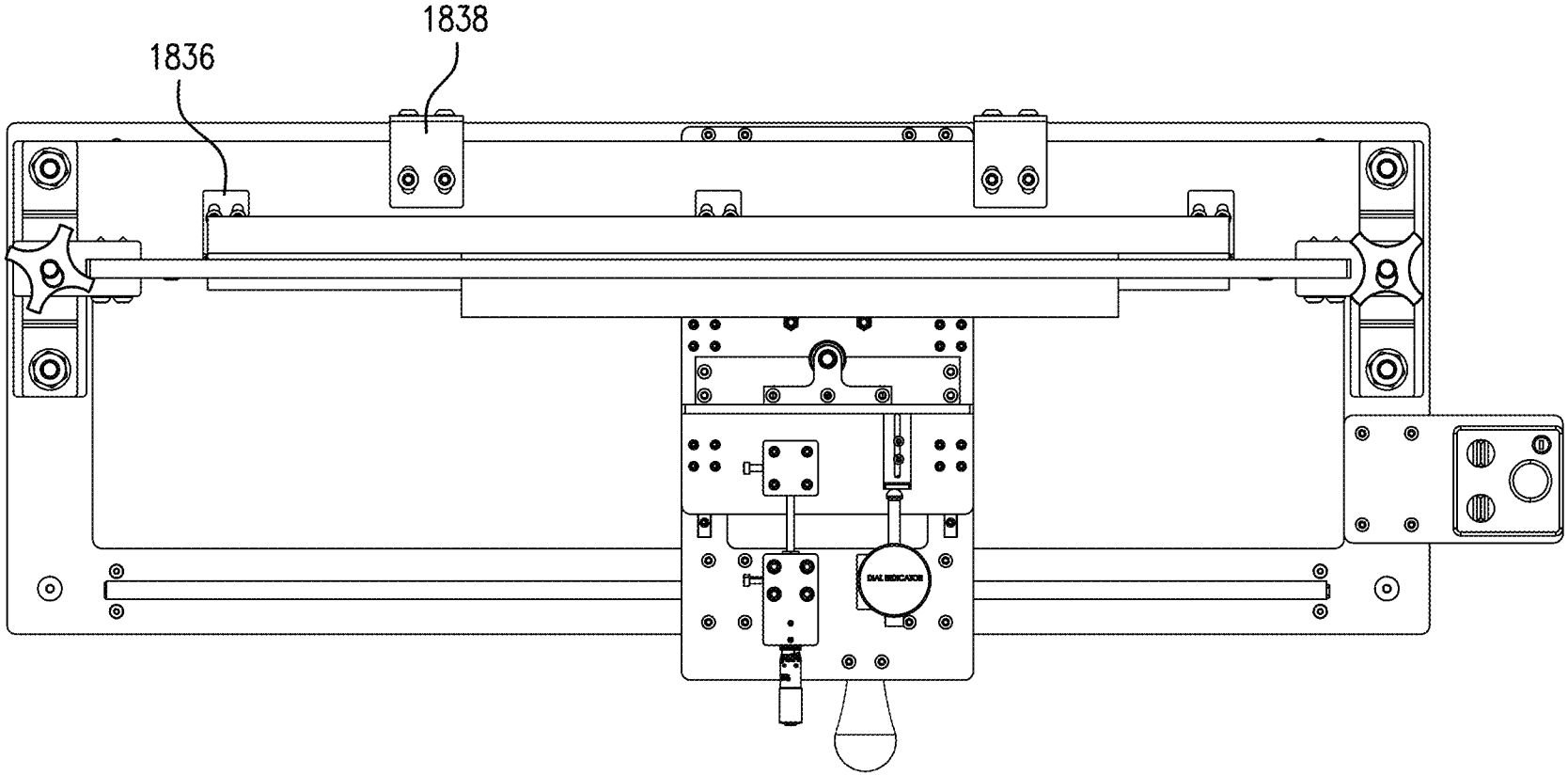
FIG. 6 is a top view of the precision squeegee grinder device of FIG. 1 according to embodiments.
Figure 7:
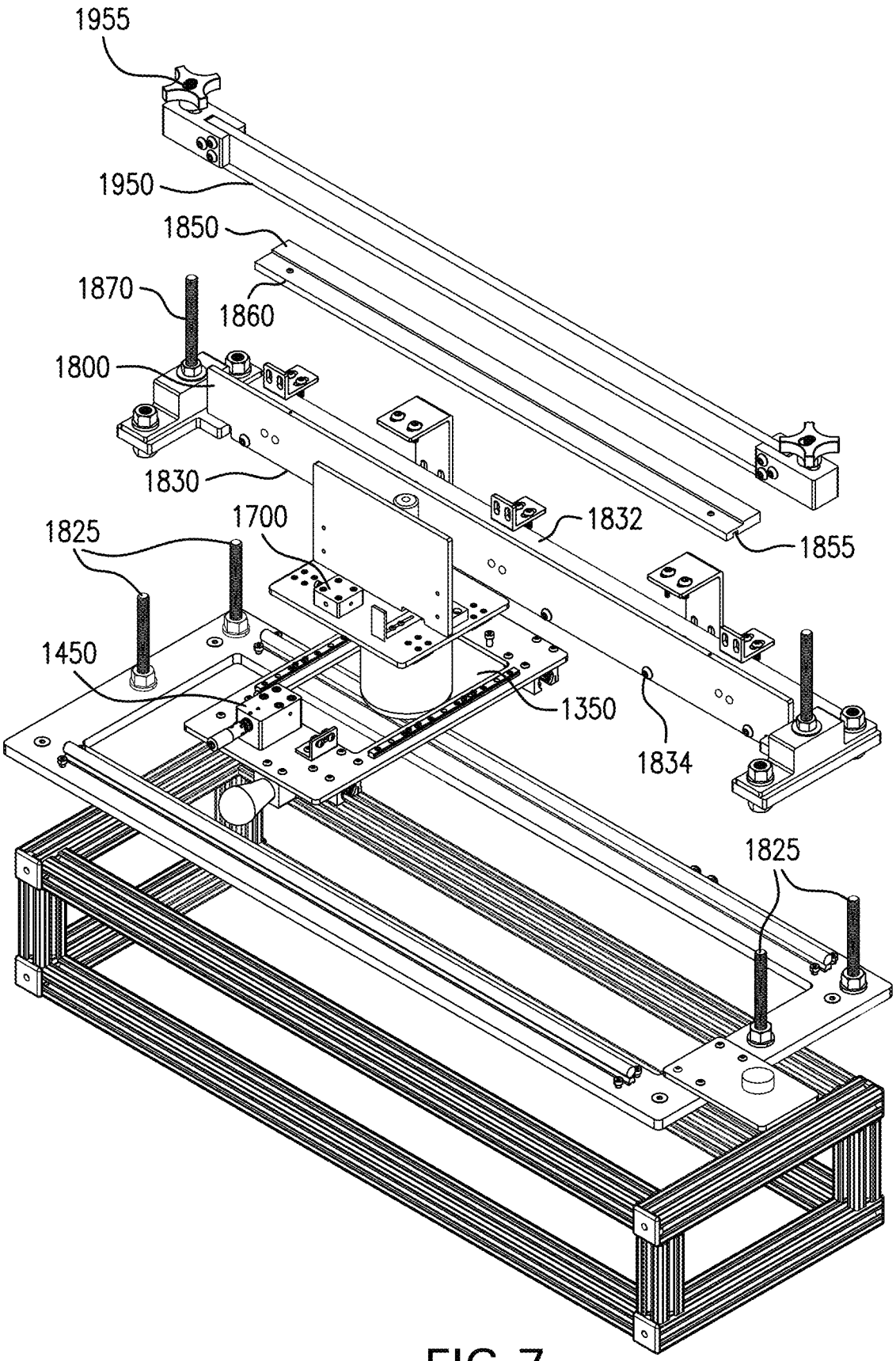
FIG. 7 is an exploded view of a precision squeegee grinder according to embodiments according to embodiments.

The figures and descriptions provided herein may be simplified to illustrate aspects of the described embodiments that are relevant for a clear understanding of the herein disclosed processes, machines, manufactures, and/or compositions of matter, while eliminating for the purpose of clarity other aspects that may be found in typical similar devices, systems, compositions and methods. Those of ordinary skill may thus recognize that other elements and/or steps may be desirable or necessary to implement the devices, systems, compositions and methods described herein. However, because such elements and steps are well known in the art, and because they do not facilitate a better understanding of the disclosed embodiments, a discussion of such elements and steps may not be provided herein. However, the present disclosure is deemed to inherently include all such elements, variations, and modifications to the described aspects that would be known to those of ordinary skill in the pertinent art in light of the discussion herein.

Embodiments are provided throughout so that this disclosure is sufficiently thorough and fully conveys the scope of the disclosed embodiments to those who are skilled in the art. Numerous specific details are set forth, such as examples of specific aspects, devices, and methods, to provide a thorough understanding of embodiments of the present disclosure. Nevertheless, it will be apparent to those skilled in the art that certain specific disclosed details need not be employed, and that embodiments may be embodied in different forms. As such, the exemplary embodiments set forth should not be construed to limit the scope of the disclosure.

The terminology used herein is for the purpose of describing particular embodiments only and is not intended to be limiting. For example, as used herein, the singular forms "a", "an" and "the" may be intended to include the plural forms as well, unless the context clearly indicates otherwise. The terms "comprises," "comprising," "including," and "having," are inclusive and therefore specify the presence of stated features, steps, operations, elements, and/or components, but do not preclude the presence or addition of one or more other features, steps, operations, elements, components, and/or groups thereof.

The steps, processes, and operations described herein are thus not to be construed as necessarily requiring their respective performance in the particular order discussed or illustrated, unless specifically identified as a preferred or required order of performance. It is also to be understood that additional or alternative steps may be employed, in place of or in conjunction with the disclosed aspects.

Yet further, although the terms first, second, third, etc. may be used herein to describe various elements, steps or aspects, these elements, steps or aspects should not be limited by these terms. These terms may be only used to distinguish one element or aspect from another. Thus, terms such as "first," "second," and other numerical terms when used herein do not imply a sequence or order unless clearly indicated by the context. Thus, a first element, step, component, region, layer or section discussed below could be termed a second element, step, component, region, layer or section without departing from the teachings of the disclosure.

Polyurethane squeegee blades are used for screen printing circuitry trace lines. It is required to refurbish and/or renew these polyurethane squeegee blades by grinding down their leading edge. This grinding must be done with extreme precision and consistency. The grinder device must be able to grind squeegee blades that are permanently bonded to proprietary squeegee holders as well as squeegee blades that are not. This mechanism should also be a table-top unit that takes up a minimal footprint.

The devices described herein provide precision and consistency by incorporating completely adjustable, and tight-tolerance machine components. The device is a tri-axis or triaxial device which permits precision movement, alignment, and/or calibration in the x, y and z axes. In addition, both sets of linear guides described herein can be aligned parallel. This allows for smooth, undisturbed movement which in turns creates a uniform grind on the squeegee blade.

In an implementation, the squeegee mount can be leveled and/or aligned with a carriage plate's horizontal movement. This allows the squeegee blades to be grinded evenly over their entire length and at a square, 90-degree angle. A micrometer head and digital dial indicator allow for calculated latitudinal movement of the diamond grinding wheel. This allows the user to grind away precise amounts of the squeegee blade's leading edge. For electronic printing, a resolution of the edge or surface of the squeegee is on the order of 8-16 micro inches. Accordingly, the device enables precision and uniform grinding of the squeegee at the necessitated resolutions.

In addition to the device's precision, the device can handle squeegees mounted in proprietary squeegee holders since once a squeegee blades is mounted in one of these holders, the squeegee blade cannot be removed. In an implementation, the device vertically clamps onto the polyurethane squeegee blade and suspends its corresponding holder in the air. Because the squeegee is mounted in this fashion, the device permits square, 90-degree grinds of the squeegee edge. In an implementation, the device can handle bare or unmounted squeegees.

FIGS. 1-7 are different views of a precision squeegee grinder device 1000 according to embodiments. The precision squeegee grinder device 1000 includes a frame 1050. In an implementation, the frame 1050 is made of aluminum. A base plate 1100 is attached to the frame 1050. In an implementation, the base plate 1100 is bolted to the frame 1050 using fasteners 1075. The base plate 1100 includes a pair of linear guides 1150 attached along an x direction, longitudinal axis, or length of the base plate 1100. The pair of linear guides 1150 allow a carriage plate 1250 to translate smoothly across the length of the base plate 1100. In an implementation, the pair of linear guides 1150 are adjustable linear rails or bearings. The pair of linear guides 1150 can be calibrated to be parallel to a squeegee mount 1800 to ensure a smooth and even grind. An emergency stop plate assembly 1200 is attached to one end of the base plate 1100 and is electrically connected to stop the precision squeegee grinder device 1000 in the event of an emergency.

The carriage plate 1250 is used to translate a cross-slide plate 1300, and thus a diamond wheel grinder 1550, longitudinally along a length of a squeegee blade 1900. The carriage plate 1250 translates along the pair of linear guides 1150 of the base plate 1100. The carriage plate 1250 has a handle 1275 for moving the carriage plate 1250 along the pair of linear guides 1150. The carriage plate 1250 includes a cutout 1350 (seen best in FIG. 7) to allow for clearance of an electric motor 1600 as the cross-slide plate 1300 translates in a y direction, latitudinally, or in a forward or backward direction relative to the squeegee mount 1800. The carriage plate 1250 includes a pair of linear guides 1400 attached along an y direction, langitudinal axis, or width of the carriage plate 1250. The pair of linear guides 1400 allow the cross-slide plate 1300 to translate freely along the width of the cutout 1350. In an implementation, the pair of linear guides 1400 are adjustable linear rails or bearings. A precision micrometer head 1450 and a dial indicator 1500 are attached to the carriage plate 1250. In an implementation, the dial indicator 1500 is a digital dial indicator. The precision micrometer head 1450 and the dial indicator 1500 can be used collectively to locate, position, and/or translate the cross-slide plate 1300 latitudinally with respect to the squeegee mount 1800. In an implementation, the movement resolution of the precision micrometer head 1450 and the dial indicator 1500 is 1/1000 of an inch.

Figure 10:
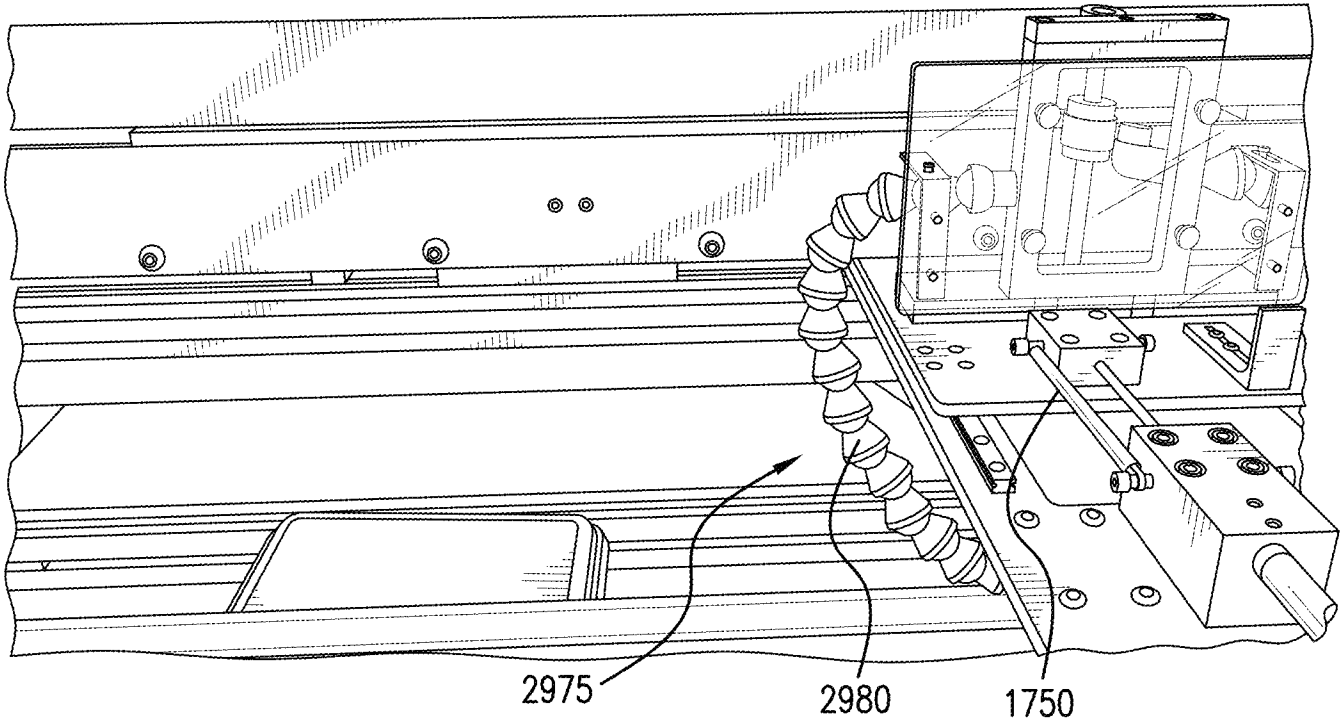
FIG. 10 is a front photograph of the precision squeegee grinder of FIG. 8 according to embodiments.
Figure 12:
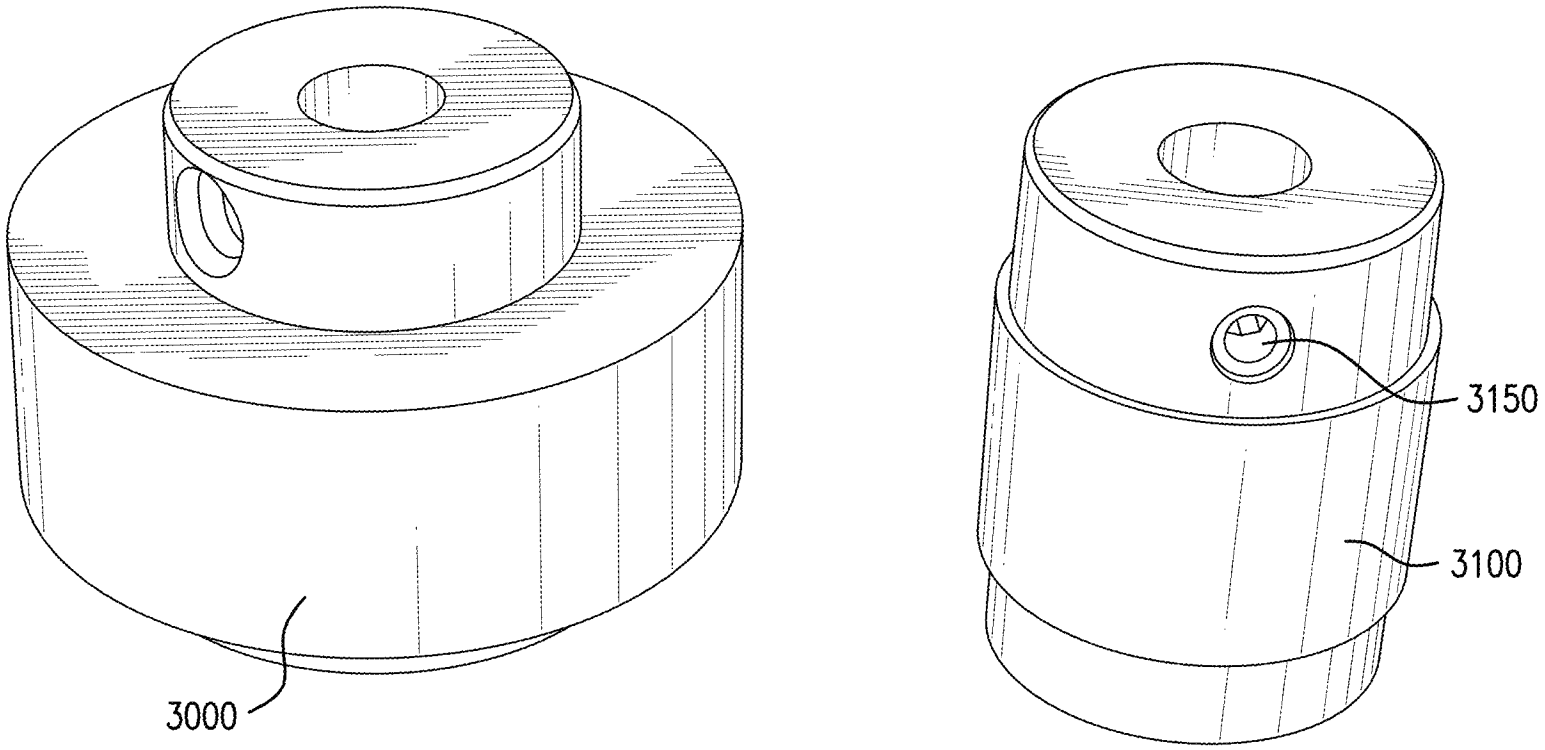
FIG. 12 is a photograph of a 1000 grit grinder wheel compared to a 360 grit grinder wheel.

The cross-slide plate 1300 can be used to grind a calculated amount of material from the squeegee blade's 1900 leading edge. The cross-slide plate 1300 implements this by vertically mounting the diamond wheel grinder 1550 and the electric motor 1600. The diamond wheel grinder 1550 includes an integrated set screw 3150 (an example is shown in FIG. 12) for vertical alignment with a squeegee mount 1800. The electric motor 1600 is mounted beneath the cross-slide plate 1300 and drives the output shaft 1650 which in turn drives the diamond wheel grinder 1550. An output shaft 1650 runs upward, through the cross-slide plate 1300 where it is attached to the diamond wheel grinder 1550 and to a bearing assembly 1675. The bearing assembly 1675 inhibits or prevents wobbles or deflection of the output shaft 1650. The cross-slide plate 1300 translates on the pair of linear guides 1400 on the carriage plate 1250. The movement is collectively controlled by the precision micrometer head 1450 and the dial indicator 1500 on the carriage plate 1250. The cross-slide plate 1300 includes stoppers 1700 for the precision micrometer head 1450 and the dial indicator 1500 that are attached to the carriage plate 1250. The stoppers 1700 are tension connected to or spring loaded with the precision micrometer head 1450 via a spring 1750 (as shown in FIG. 10). This arrangement permits precise and/or measured translation of the cross-slide plate 1300 and prevents unwanted latitudinal movement. The cross-slide plate 1300 includes a shield 1750 to protect a user from contacting the diamond wheel grinder 1550 or from any grinded materials. In an implementation, the shield 1750 is a plexiglass shield or the like.

A squeegee mount 1800 is suspended off the base plate 1100 using a set of fasteners 1825. In an implementation, the set of fasteners 1825 can be threaded rods with associated nuts. The set of fasteners 1825 allows for full adjustability and accurate leveling of the squeegee mount 1800 in the z axis. In an implementation, the squeegee mount 1800 includes a first plate 1830, a second plate 1832, and assembly hardware 1834. The first plate 1830 and the second plate 1832 are machined flat for precise mounting of the squeegee blade 1900. The first plate 1830 and the second plate 1832 are attached at a right angle using the assembly hardware 1834. The first plate 1830 and the second plate 1832 span the entire length of the base plate 1100. In an implementation, the first plate 1830 and the second plate 1832 are braced for additional support using braces 1836. In an implementation, the first plate 1830 and the second plate 1832 are also braced to the base plate 1100 using braces 1838 to prevent unwanted bowing. In an implementation, the squeegee mount 1800 can hold proprietary squeegee blade holders. In an implementation, a bare squeegee adapter 1850 can be fastened directly onto the squeegee mount 1800 when it is necessary to grind bare squeegee blades 1900 that are not mounted in proprietary squeegee blade holders.

As noted, the bare squeegee adapter 1850 can be used to precisely mount bare squeegee blades 1900 onto the squeegee mount 1800. The bare squeegee adapter 1850 includes a a cutout 1855 on its bottom side to slip directly onto the vertically oriented plate of the squeegee mount 1800, i.e. the first plate 1830, and fastened into position. The bare squeegee adapter 1850 has a machined lip 1860 that allows the user to seat a bare squeegee blade 1900 perfectly parallel to the squeegee mount 1800.

A squeegee clamp 1950 can be used to secure the squeegee blade 1900 while it is being grinded. The squeegee clamp 1950 slides directly onto two threaded rods 1870 from the squeegee mount 1800 and can be tightened onto the squeegee blade 1900 by threaded knobs 1955 on the squeegee clamp 1950.

A vacuum system (shown in the photographs of FIGS. 8-11) prevents polyurethane debris from seizing up the pair of linear guides 1150 and 1400. In an implementation, vacuum lines can run directly to the diamond wheel grinder 1550 to catch the debris.

Figure 14A:
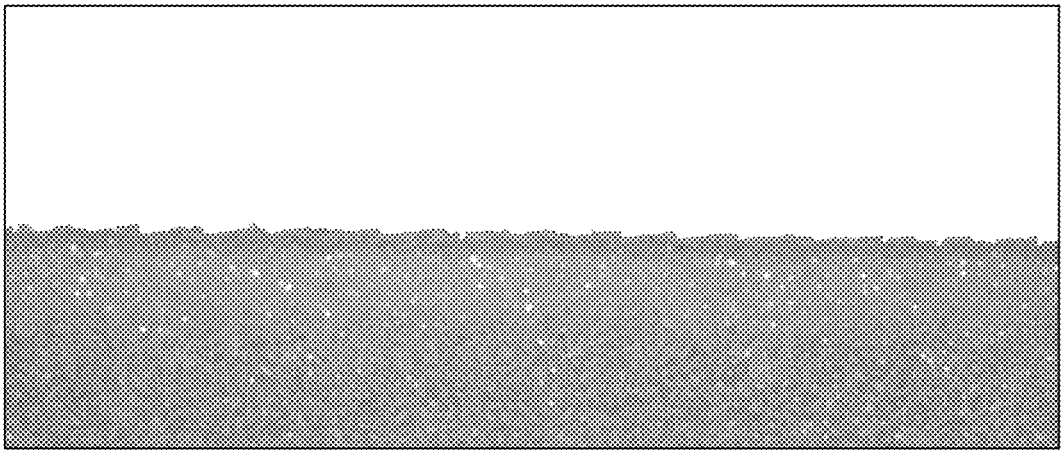
FIGS. 14A and 14B are photographs of a squeegee before and after using the precision squeegee grinder device, respectively, according to embodiments.
Figure 14B:
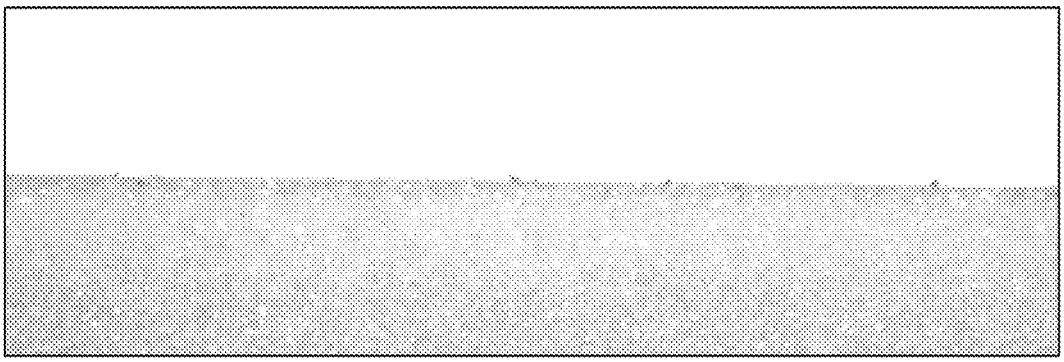

Operationally, the precision squeegee grinder device 1000 uses the pair of linear guides 1150 and 1400 along with the precision micrometer head 1450 and the dial indicator 1500 to precisely control and provide a smooth, undisturbed movement that in turns creates a uniform grind on the squeegee blade 1900. In addition, since the squeegee mount 1800 can be leveled and/or aligned with the carriage plate's 1250 horizontal movement, the squeegee blades 1900 can be grinded evenly over their entire length and at a square, 90-degree angle. The precision micrometer head 1450 and the dial indicator 1500 allow for calculated latitudinal movement of the diamond wheel grinder 1550. This allows the user to grind away precise amounts of the squeegee blade's 1900 leading edge. FIGS. 14A and 14B are photographs of a squeegee before and after using the precision squeegee grinder device 1000, respectively.

Figure 8:
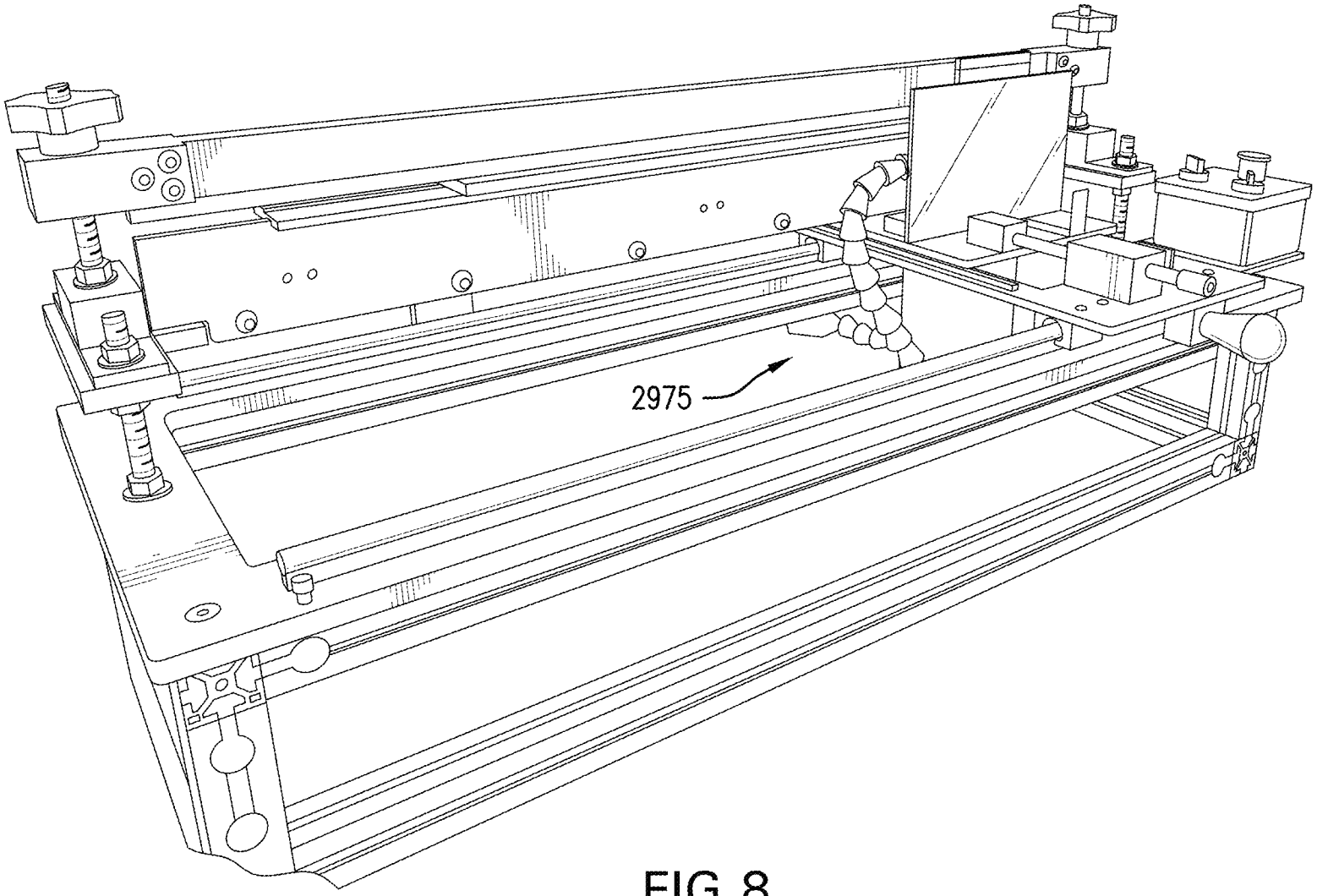
FIG. 8 is a perspective photograph of a precision squeegee grinder according to embodiments.
Figure 9:
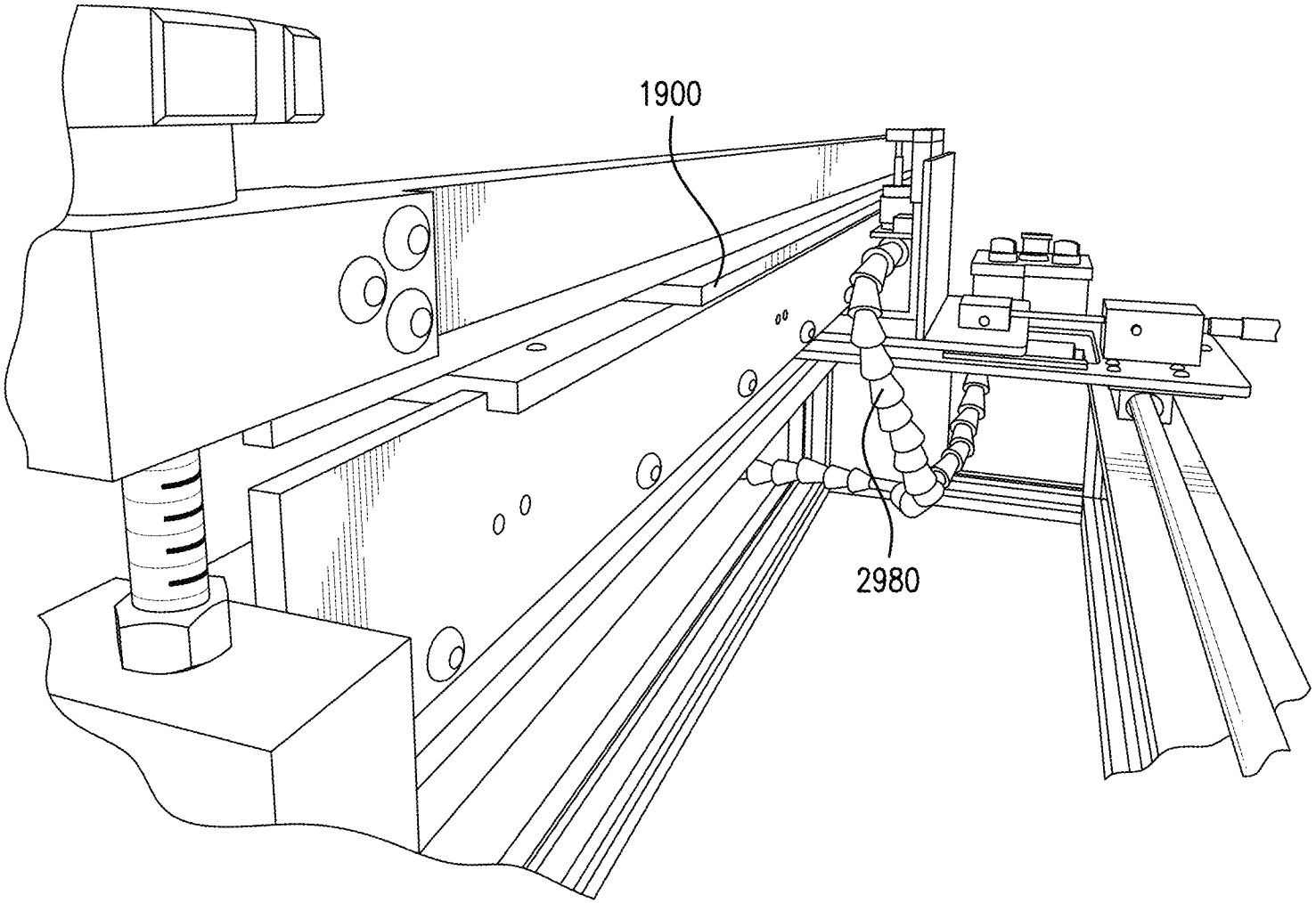
FIG. 9 is a side perspective photograph of the precision squeegee grinder of FIG. 8 according to embodiments.
Figure 11:
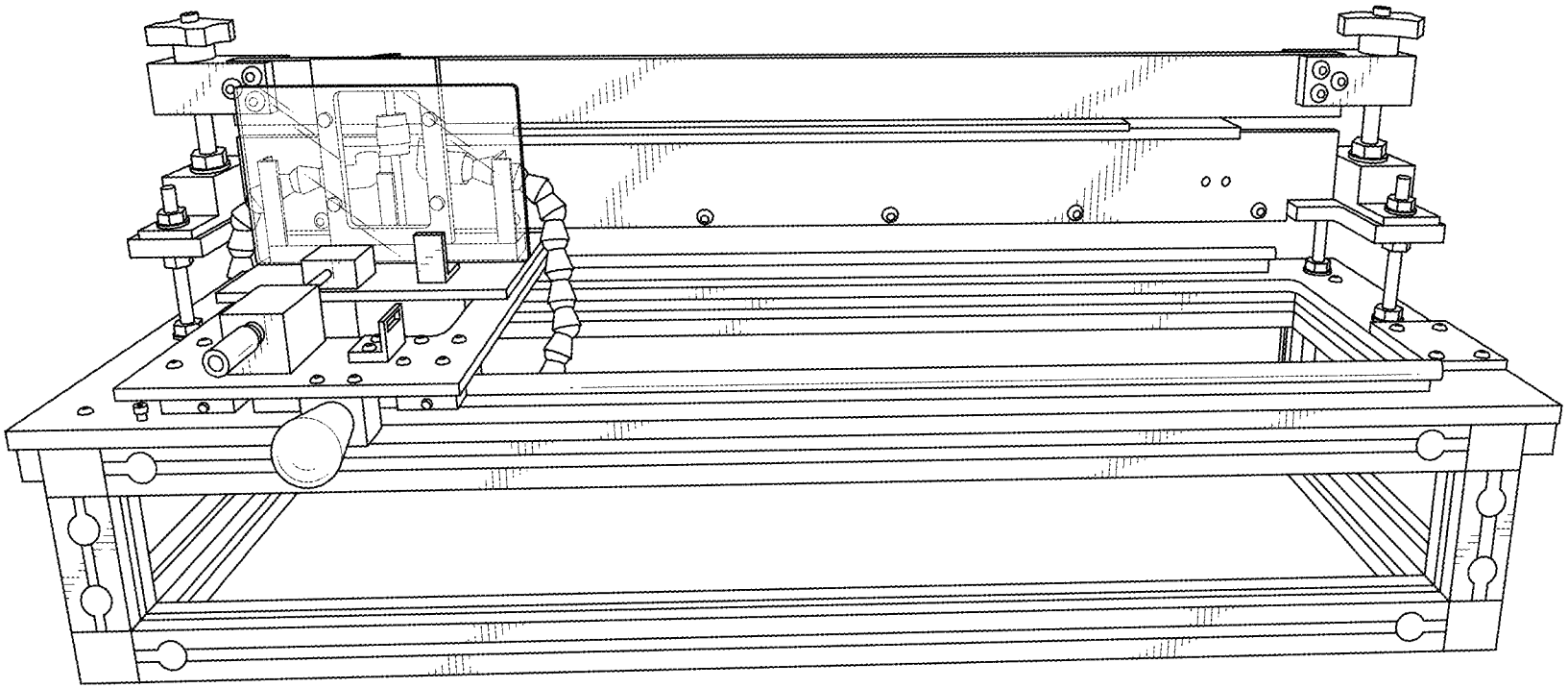
FIG. 11 is another front photograph of the precision squeegee grinder of FIG. 8 according to embodiments.

FIG. 8 is a perspective photograph of a precision squeegee grinder 2000 according to embodiments. This photograph of the precision squeegee grinder 2000 illustrates some of the components described with respect to FIGS. 1-7 including frame 2050, base plate 2100, pair of linear guides 2150, and emergency stop plate assembly 2200, for example. In addition, the precision squeegee grinder 2000 includes a vacuum system 2975 with vacuum lines 2980. FIG. 9 is a side perspective photograph of the precision squeegee grinder of FIG. 8. FIG. 10 is a front photograph of the precision squeegee grinder of FIG. 8. FIG. 11 is another front photograph of the precision squeegee grinder of FIG. 8.

FIG. 12 is a photograph of a 1000 grit grinder wheel 3000 compared to a 360 grit grinder wheel 3100. As noted above, a resolution of the edge or surface of the squeegee is on the order of 8-16 micro inches. The 1000 grit grinder wheel 3000 along with the device enables precision and uniform grinding of the squeegee at the necessitated resolutions.

Figure 13:
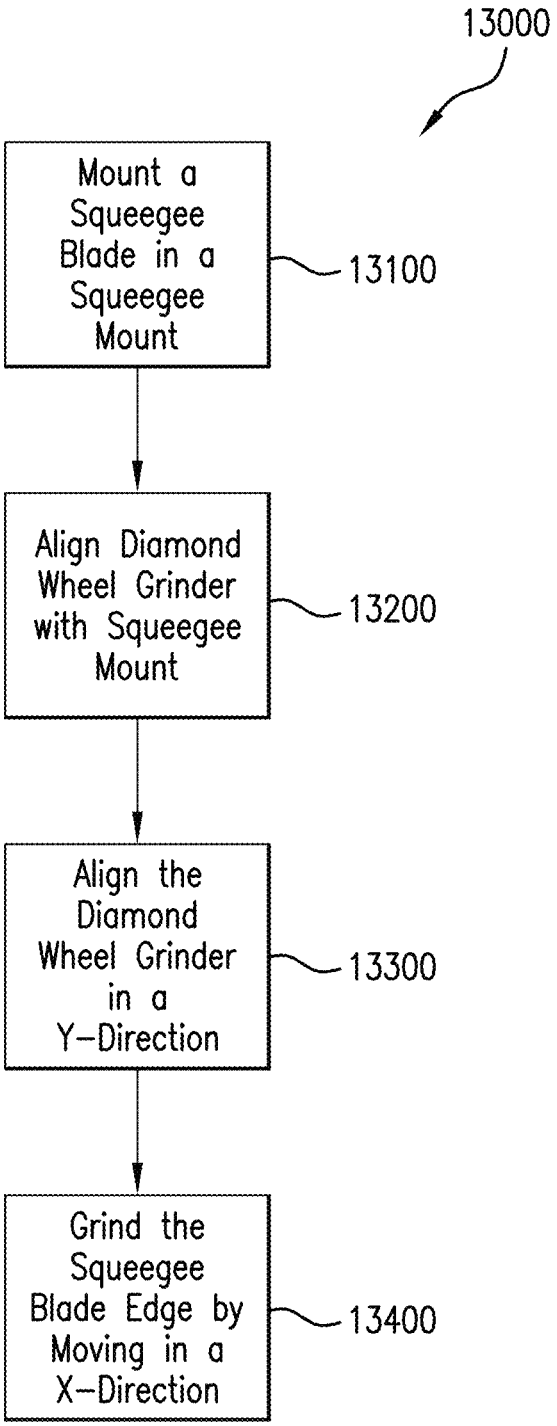
FIG. 13 is an example method for precision grinding of a squeegee blade edge according to embodiments.

FIG. 13 is an example method 13000 for precision grinding of a squeegee blade edge. The method 13000 includes mounting 13100 a squeegee blade in a squeegee mount; aligning 13200 a diamond wheel grinder with the squeegee mount; aligning 13300 the diamond wheel grinder in a y direction; and grinding 13400 the squeegee blade edge by moving in a x direction. The method 13000 may be implemented in the devices shown in FIGS. 1-11 using the 1000 grit grinder shown in FIG. 12, for example.

The method 13000 includes mounting 13100 a squeegee blade in a squeegee mount. In an implementation, a bare squeegee blade can be mounted in a precision squeegee grinder. In an implementation, a squeegee blade mounted in a holder can be mounted in the precision squeegee grinder.

The method 13000 includes aligning 13200 a diamond wheel grinder with the squeegee mount. The squeegee mount of the precision squeegee grinder is leveled. The diamond wheel grinder is vertically aligned with the squeegee mount by turning an integrated set screw in the diamond wheel grinder.

The method 13000 includes aligning 13300 the diamond wheel grinder in a y direction. The diamond wheel grinder is aligned relative to the edge of the squeegee blade using a precision micrometer and display as described herein.

The method 13000 includes grinding 13400 the squeegee blade edge by moving the diamond wheel grinder along the x direction.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A precision squeegee grinder comprising:

a grinder assembly configured to grind an edge of a squeegee blade;

a squeegee mounting assembly configured to hold the squeegee blade, the grinder assembly vertically alignable with respect to the squeegee mounting assembly;

a latitudinal movement assembly connected to the grinder assembly, the latitudinal movement assembly configured to position the grinder assembly with respect to the squeegee blade in defined increments;

a longitudinal movement assembly connected to the latitudinal movement assembly, the longitudinal movement assembly configured to move the grinder assembly along a width of the squeegee blade; and a base assembly comprising a base plate and a first pair of linear guides connected to the base plate, the first pair of linear guides configured to guide movement of the longitudinal movement assembly along the width of the squeegee blade, wherein the grinder assembly, the squeegee mounting assembly, the latitudinal movement assembly, and the longitudinal movement assembly are connected to the base assembly, wherein the longitudinal movement assembly comprising:

a carriage plate configured to glide on the first pair of linear guides, the carriage plate comprising:

a micrometer and a dial indicator;

a second pair of linear guides, the second pair of linear guides configured to guide movement of the latitudinal movement assembly with respect to the squeegee blade; and a cutout region configured to allow movement of the latitudinal movement assembly, wherein the latitudinal movement assembly comprising:

a cross-slide plate configured to glide on the second pair of linear guides, the cross-slide plate comprising:

a stopper configured to be engaged with the micrometer, wherein the micrometer engages the stopper to drive movement of the cross-slide plate across the second pair of linear guides, and wherein the squeegee mounting assembly, the latitudinal movement assembly, and the longitudinal movement assembly enable triaxial alignment between the grinder assembly and the squeegee blade.

2. The precision squeegee grinder of claim 1, the longitudinal movement assembly further comprising:

a handle for moving the carriage plate on the first pair of linear guides.

3. The precision squeegee grinder of claim 1, the latitudinal movement assembly further comprising:

a plexiglass shield.

4. The precision squeegee grinder of claim 3, the grinder assembly further comprising:

a diamond wheel grinder;

a bearing assembly;

a motor; and an output shaft connected to the motor and to the bearing assembly and the diamond wheel grinder via an opening in the cross-slide plate, wherein the motor drives the diamond wheel grinder via the output shaft, and wherein the bearing assembly inhibits deflections of the output shaft.

5. The precision squeegee grinder of claim 4, the squeegee mounting assembly further comprising:

a squeegee mount; and a squeegee clamp, wherein the squeegee blade is held between the squeegee mount and the squeegee clamp.

6. The precision squeegee grinder of claim 5, the squeegee mounting assembly further comprising:

a bare squeegee adapter configured to engage a bare squeegee blade, wherein the bare squeegee adapter fits on the squeegee mount.

7. A precision squeegee grinder comprising:

a base plate;

a squeegee mounting assembly configured to hold the squeegee blade;

a grinder assembly vertically alignable with respect to the squeegee mounting assembly on a first axis;

a second axis movement assembly connected to the grinder assembly, the second axis movement assembly configured to position the grinder assembly along a second axis;

a third axis movement assembly connected to the second axis and the base plate, the third axis movement assembly configured to position the grinder assembly along a third axis; and third axis linear guides connected to the base plate, the third axis linear guides configured to guide movement of the third axis movement assembly, wherein the third axis movement assembly further comprising:

a carriage plate configured to glide on the third axis linear guides, the carriage plate further comprising:

a micrometer and a dial indicator;

second axis linear guides, the second axis linear guides configured to guide movement of the second axis movement assembly; and a cutout region configured to allow movement of the second axis movement assembly, wherein the second axis movement assembly further comprising:

a cross-slide plate configured to glide on the second axis linear guides, the cross-slide plate further comprising:

a stopper configured to be engaged with the micrometer, wherein the micrometer engages the stopper to drive movement of the cross-slide plate across the second axis linear guides, and wherein triaxial alignment between the grinder assembly and the squeegee blade is enabled via the squeegee mounting assembly, the second axis movement assembly, and the third axis movement assembly.

8. The precision squeegee grinder of claim 7, the third axis movement assembly further comprising:

a handle for moving the carriage plate on the third axis linear guides.

9. The precision squeegee grinder of claim 7, the second axis movement assembly further comprising:

a plexiglass shield.

10. The precision squeegee grinder of claim 7, the grinder assembly further comprising:

a diamond wheel grinder;

a bearing assembly;

a motor; and an output shaft connected to the motor and to the bearing assembly and the diamond wheel grinder via an opening in the cross-slide plate, wherein the motor drives the diamond wheel grinder via the output shaft, and wherein the bearing assembly inhibits deflections of the output shaft.

11. The precision squeegee grinder of claim 10, the squeegee mounting assembly further comprising:

a squeegee mount; and a squeegee clamp, wherein the squeegee blade is held between the squeegee mount and the squeegee clamp.

12. The precision squeegee grinder of claim 11, the squeegee mounting assembly further comprising:

a bare squeegee adapter configured to engage a bare squeegee blade, wherein the bare squeegee adapter fits on the squeegee mount.

* * * * *